US006250596B1

(12) United States Patent
Gordin et al.

(10) Patent No.: US 6,250,596 B1
(45) Date of Patent: Jun. 26, 2001

(54) SPACER BETWEEN POLE AND CROSS-ARM

(75) Inventors: Myron K. Gordin; Timothy J. Boyle, both of Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 0 days.

(21) Appl. No.: 09/078,366

(22) Filed: May 13, 1998

(51) Int. Cl.[7] ..... A47B 96/06; H02B 1/18

(52) U.S. Cl. ..... 248/230.1; 248/218.4; 248/219.3; 361/674; 408/292

(58) Field of Search ..... 248/121, 219.2, 248/218.4, 229.17, 219.3, 219.4, 230.8, 230.1; 403/395, 65, 270, 271, 292; 361/674

(56) References Cited

U.S. PATENT DOCUMENTS

| | | | | |
|---|---|---|---|---|
| D. 337,168 | * | 7/1993 | Gordin et al. | D25/127 |
| D. 411,096 | * | 6/1999 | Gordin et al. | D8/349 |
| 453,286 | | 6/1891 | Lieb . | |
| 595,600 | | 12/1897 | Buck . | |
| 732,223 | | 6/1903 | Rhoades . | |
| 1,083,120 | | 12/1913 | May . | |
| 1,434,352 | * | 10/1922 | Jester | 403/395 |
| 1,567,301 | | 12/1925 | Ross . | |
| 2,036,771 | | 4/1936 | Pfistershammer . | |
| 2,066,419 | | 1/1937 | Pfistershammer . | |
| 2,663,531 | * | 12/1953 | Rubano | 248/229.17 |
| 2,940,714 | * | 6/1960 | Waidt | 248/218.4 |
| 3,107,932 | * | 10/1963 | Johnson et al. | 24/335 |
| 3,646,401 | | 2/1972 | Freegard et al. . | |
| 3,713,262 | | 1/1973 | Jatcko . | |
| 3,865,498 | | 2/1975 | Okuto et al. . | |
| 3,958,381 | | 5/1976 | Meyer . | |
| 3,991,532 | | 11/1976 | Buxbom . | |
| 4,033,080 | | 7/1977 | Fukushima | 52/223.4 |
| 4,092,079 | | 5/1978 | Swanson | 403/306 |
| 4,190,881 | | 2/1980 | Drost et al. | 362/250 |
| 4,246,732 | | 1/1981 | Frehner | 52/726.4 |
| 4,272,929 | | 6/1981 | Hanson | 464/516 |
| 4,374,407 | | 2/1983 | Drost et al. | 362/432 |
| 4,393,435 | | 7/1983 | Petrina | 361/674 |
| 4,617,768 | | 10/1986 | Gebelius | 52/40 |
| 4,673,157 | | 6/1987 | Wells | 249/13 |
| 4,719,540 | | 1/1988 | San George et al. | 361/674 |
| 4,779,389 | | 10/1988 | Landers | 52/164.13 |
| 4,878,160 | * | 10/1989 | Reneau et al. | 362/269 |
| 4,894,759 | | 1/1990 | Siems | 362/250 |
| 4,934,644 | * | 6/1990 | Nagy et al. | 248/230.8 |
| 5,023,520 | | 6/1991 | Costa | 315/276 |
| 5,038,430 | * | 8/1991 | Bly | 5/425 |
| 5,600,537 | * | 2/1997 | Gordin et al. | 361/674 |
| 5,634,619 | * | 6/1997 | Alessi | 248/219.3 |
| 5,738,317 | * | 4/1998 | Hugron | 248/176.1 |
| 5,752,685 | * | 5/1998 | Tyan | 248/218.4 |

FOREIGN PATENT DOCUMENTS

| | | |
|---|---|---|
| 2255713 | 5/1974 | (DE) . |
| 2708664 | 9/1977 | (DE) . |
| 3440531C1 | 3/1986 | (DE) . |
| 0957 218 A2 | 4/2000 | (EP) . |
| 0957 218 A3 | 4/2000 | (EP) . |
| 2536780 | 6/1984 | (FR) . |
| 426074 | 3/1935 | (GB) . |
| 705891 | 3/1954 | (GB) . |
| 717699 | 11/1954 | (GB) . |

OTHER PUBLICATIONS

Centrecon Sportsliner II/50 (Brochure) (Prior to Feb. 6, 1991) 4 Pages.

Centrecon, Inc., FL Series Floodlighting (Brochure) (Prior to Feb. 6, 1991), 2 pp.

* cited by examiner

*Primary Examiner*—Anita M. King
(74) *Attorney, Agent, or Firm*—Zarley, McKee, Thomte, Voorhees & Sease

(57) ABSTRACT

An apparatus and method for connecting a cross-arm to a pole. The apparatus includes a portion which completely surrounds the pole and an extending member extending transversely or outwardly from the pole. A cross-arm is connectable to the extended member.

17 Claims, 6 Drawing Sheets

SPACER BETWEEN POLE AND CROSS-ARM

BACKGROUND OF THE INVENTION

1. Field of the Invention

The present invention relates to poles for elevating items, and in particular to apparatus and methods of attaching cross-arms to vertical poles.

2. Problems in the Art

Different ways to attach cross-arms to vertical poles have evolved over the years. Wooden poles remain one popular method of elevating structures. Cross-arms are generally attached to wooden poles by clamps which surround the solid wooden pole. Clamps are also used to attach cross-arms to concrete and hollow metal poles. Some of the problems with the use of clamps include the risk that the clamping hardware will deteriorate or fatigue over the years. This includes the possibility of the clamping hardware loosening and making the cross-arm subject to failure. It is also time-consuming and sometimes difficult to install cross-arms with clamps. Many times the installation must occur after the vertical pole has been anchored in the ground. The installer must therefore be elevated to the location that the cross-arm is to be placed and many times has to work from substantial heights with cross-arms that are heavy and unwieldy. Installation of cross-arms is also subject to the risk that the installer will not be completely accurate in the installation process, including insuring the correct alignment of the cross-arm to the pole, which many times can be critical. One example where such alignment is critical is when the cross-arm holds sports lighting fixtures which collectively, for several poles and several lighting fixtures, optimally will have precise aimings based on pre-calculations of height and orientation of the cross-arm.

Because of the afore-mentioned difficulties, the owner of the present invention developed what will be called a "spacer" that could be attached at one end to the pole and at the other end to a cross-arm. An example of this development can be seen in FIG. 3. Spacer 2 consists of a hollow body having one end having a curved cut-out which matches the exterior of the pole. The other end is square-cut and matches a flat side of the cross-arm. The spacer 2 could be welded to the metal pole and the metal cross-arm. The structure then does not bear the risk of a loosening of clamping hardware and is very strong.

Another benefit of spacer 2 is the fact the it holds the cross-arm a distance away from the pole. This frees up even the portion of the cross-arm right in front of the pole to be used to suspend items, including the mounting structure for a lighting fixture. Thus, a portion of the cross-arm that otherwise could not be easily utilized with some other mounting systems, can be utilized.

In the example shown in FIG. 3, spacer 2 could be utilized with a pre-fabricated vertical pole section 4 made of hollow metal and having an upper end 6 and a lower end 8. Aperture 7 along pole top 4 would be put in the position where each cross-arm 3 was to be located. Spacers 2, being hollow, would then be welded between pole top 4 over an aperture 7, and then to a cross-arm 3 which in turn would have an aperture 7', which would be surrounded by the other end of spacer 2. In this manner, not only could a pole top with cross-arms be pre-assembled at the factory, but the cross-arms and pole top could also be pre-wired through the hollow interior of section 4, through aperture 7, through hollow spacers 2, and through apertures 7' in cross-arms 3. This lends itself to pre-construction of an entire pole top, including the items to be elevated, for example, electrically powered sports lighting fixtures that would be attached as indicated at reference numeral 1 to various spaced-apart locations along cross-arms 3 (other locations not shown).

Spacers 2 at FIG. 3 therefore achieve the function of allowing a strong factory-assembled connection between pole top 4 and the cross-arms 3, along with the ability to pre-wire the same. The pole top 4, with pre-installed and pre-wired cross-arms 3, could be shipped pre-assembled to location. The bottom 8 of pole top 4 could then be slip-fit over the top of the main part of the pole to be erected, with sports lighting which could be many tens of feet tall (including over a 100 feet tall).

Such a combination is described in more detail in U.S. Pat. No. 5,600,537, issued Feb. 4, 1997, co-owned by the owner of the present application, and the contents thereof are incorporated by reference herein.

Although the structure shown in FIG. 3 works well for its intended purpose, in certain situations the structure, over long periods of time, has developed fractures at or near the junction of spacers 2 and hollow metal pole or pole top 4. Although it is not precisely known how and why such fractures occur, one explanation is that in certain environmental conditions, oscillation of cross-arms is believed to occur. Over time the oscillations or vibrations are believed to be transferred through spacers 2 to the relatively thin walled tubular pole 4. It is believed that spacers 2 can act somewhat like punching tubes which fracture the vertical tube 4 at their junction. It is believed that such fatigue problems are caused by a repeating or long-term cyclic vibration. Many times this is believed to be set up when, for example, lighting fixtures on the order of 30" diameter are supported on the cross-arms and the wind causes such vibration.

It is therefore believed that there is room for improvement with respect to the method of spacing cross-arms 3 from pole 4 as shown in FIG. 3, or, at least, room for trying to eliminate any punching action by spacers 2 relative to the pole.

It is therefore a primary object of the present invention to provide an apparatus and method for connecting and spacing a cross-arm relative a pole section which improves over or solves the problems and deficiencies in the art.

Further options, features, and advantages of the invention include an apparatus and method which:

1. Reduces or eliminates punching action by a spacer between cross-arm and pole.
2. Provides more support of the cross-arm relative to the spacer and the pole relative to the spacer.
3. Reduces or eliminates any punch-through problems between cross-arms and pole.
4. Is durable and long-lasting.

These and other objects, features, and advantages of the present invention will become more apparent with reference to the accompanying specification and claims.

SUMMARY OF THE INVENTION

The present invention relates to an apparatus and method for attaching one or more cross-arms to a vertical pole where the cross-arm is held at a somewhat spaced apart position from the pole. With respect to the apparatus, the invention comprises a spacer having a first portion including a aperture for receipt of the vertical pole. A second portion, for attachment to a cross-arm, extends from the first portion transversely relative to the aperture.

With regard to the method of the invention, a spacer member is attached in a manner so that it surrounds a part of the pole. A portion of the spacer member extends transversely away from the pole and a cross-arm is attached to the extended part of the member.

DETAILED DESCRIPTION OF THE DRAWINGS

DETAILED DESCRIPTION OF THE PREFERRED EMBODIMENT

Figure 1:
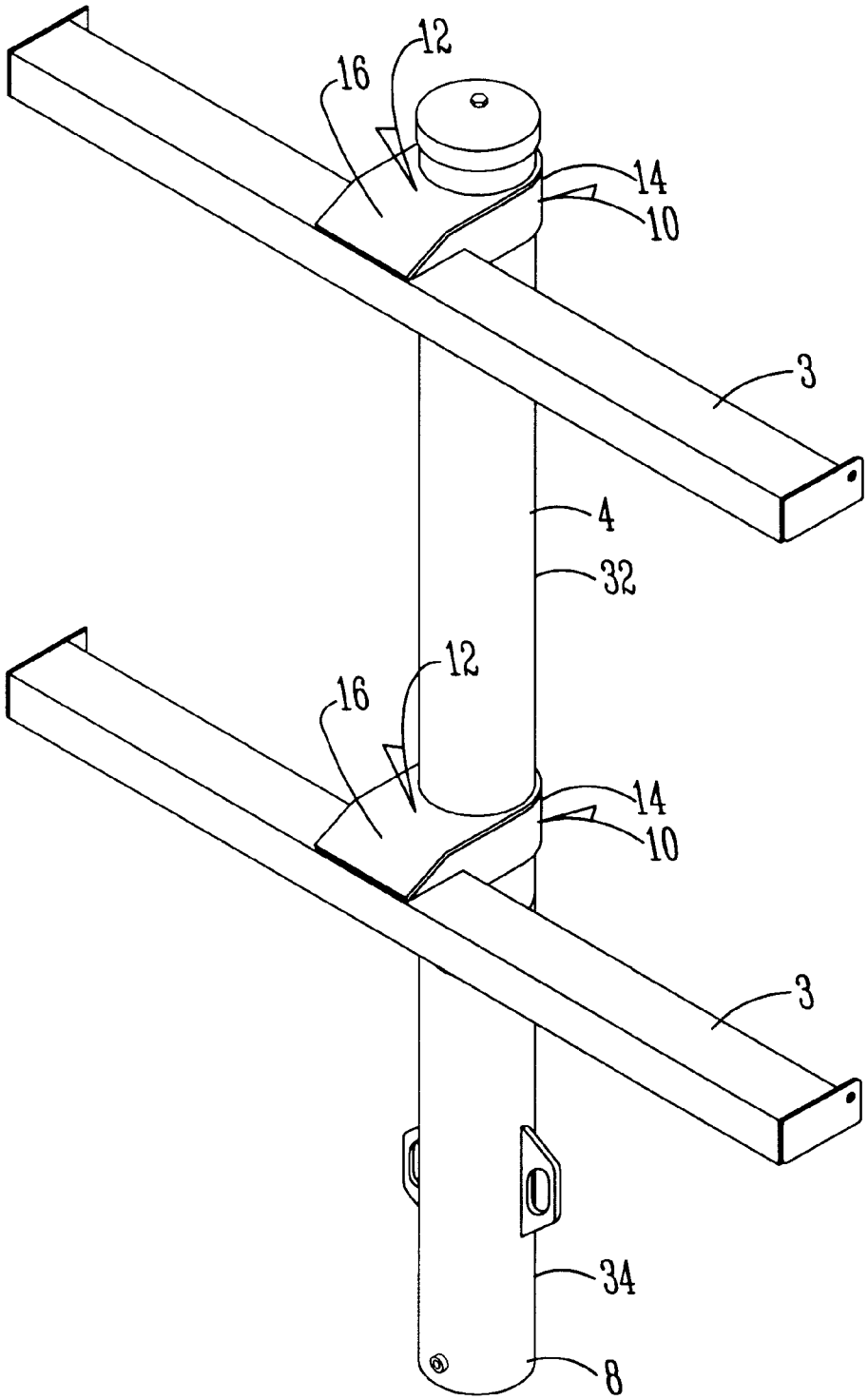
FIG. 1 is a perspective view of a preferred embodiment of the invention associated with a pole top section.

For a better understanding of the invention, a detailed description of one preferred embodiment the invention can take will now be set forth. Frequent reference will be taken to the drawings. References numerals will be used to indicate certain parts or locations in the drawings. The same reference numerals will be used to indicate the same parts and locations throughout the drawings unless otherwise indicated.

The preferred embodiment is a connection between a vertical pole section and a cross-arm. More specifically, the preferred embodiment's designed function is to suspend from an elevated height high-intensity light fixtures for wide-area sports lighting or similar applications. Therefore, the cross-arms, the connector, and the pole must be sufficiently strong and durable to suspend the plurality of fixtures, and in many cases a plurality of cross-arms, each with fixtures, at substantial heights. Thus, this strength and durability must not only apply to the inherent weight of all of those components, but also to such things as wind-load that creates additional stresses on such apparatus. All of this is well-known in the art.

For a description of some of the considerations that go into designing high-intensity lighting systems, reference can be taken to U.S. Pat. No. 5,600,537.

The specifics regarding how the lighting fixtures are mounted to the cross-arms and how the entire vertical pole is constructed and anchored in the ground will not be discussed here and are matters well within the skill and knowledge of those skilled in the art. One way is shown and described in U.S. Pat. No. 5,600,537. A comparison will be made with a prior system to assist in an understanding of the advantages of the invention.

Figure 3:
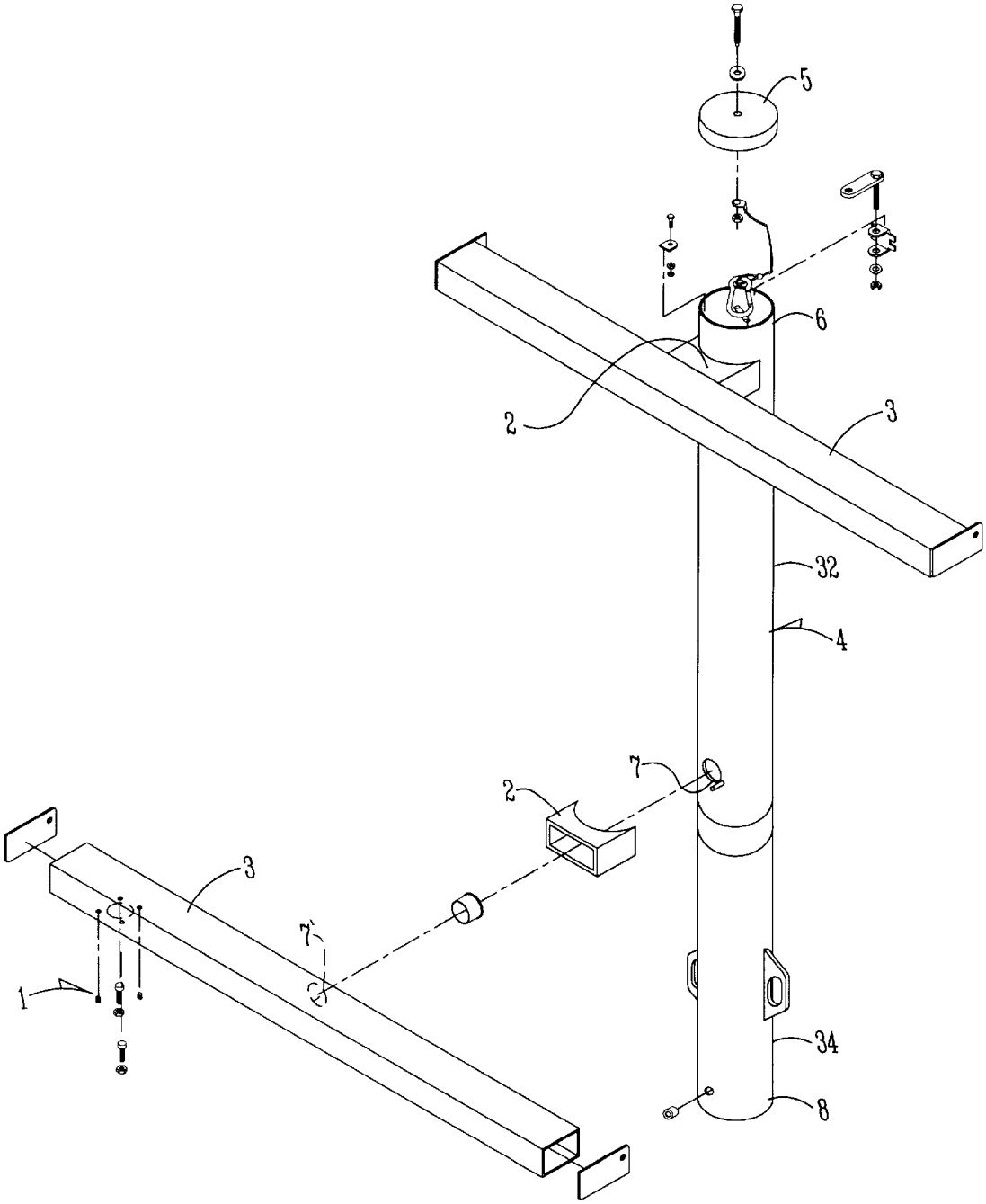
Fig.3 (PRIOR ART)
FIG. 3 is a partially exploded view similar to FIG. 2, but showing a prior spacer between pole and cross-arm.

As stated earlier, the configuration of FIG. 3 provided a strong durable way to mount metal cross-arms to metal hollow poles. It eliminates the need for clamps or other securing hardware and allows precise manufacturing, construction, preassembly, and orientation of the relative parts to one another. Pole section 4 is several feet long and, therefore, could be worked on in the factory without difficulty. In particular, it could be transported to distance locations in regular sized transportation vehicles such as conventional semi tractor-trailer combinations. The size and configuration of spacer 2 is welded between the metal of pole 4 and a cross-arm 3, and as mentioned above allowed pre-wiring. Welding of the pieces would be within the skill of those skilled in the art. The dimensions of spacer 2 would depend upon a number of factors including the size of pole 4, the size and length of cross arm 3, and the items intended to be carried by cross-arm 3. An example of one spacer 2 is as follows:

| | |
|---|---|
| Material | 3/16" Ga. Tubing, ASTM A 500 Grade B |
| Width side to side | 4" |
| Length front to back | 2.215" |
| Thickness | 2" |
| Radius to receive pole | 2 3/8" |

For larger radius poles, the dimensions change as set forth in the following table.

| Radius Of Pole | Width | Length |
|---|---|---|
| 2 7/8" | 3 3/4" | 5 3/16" |
| 5" | 6" | 8" |
| 2.542" | 2.645" | 3.045" |

As can seen in FIG. 3, spacer 2 does mate with part of the circumference of pole 4, but no more than approximately 180°. The other end of spacer 2 abuts a vertical flat surface of cross-arm 3.

Figure 2:
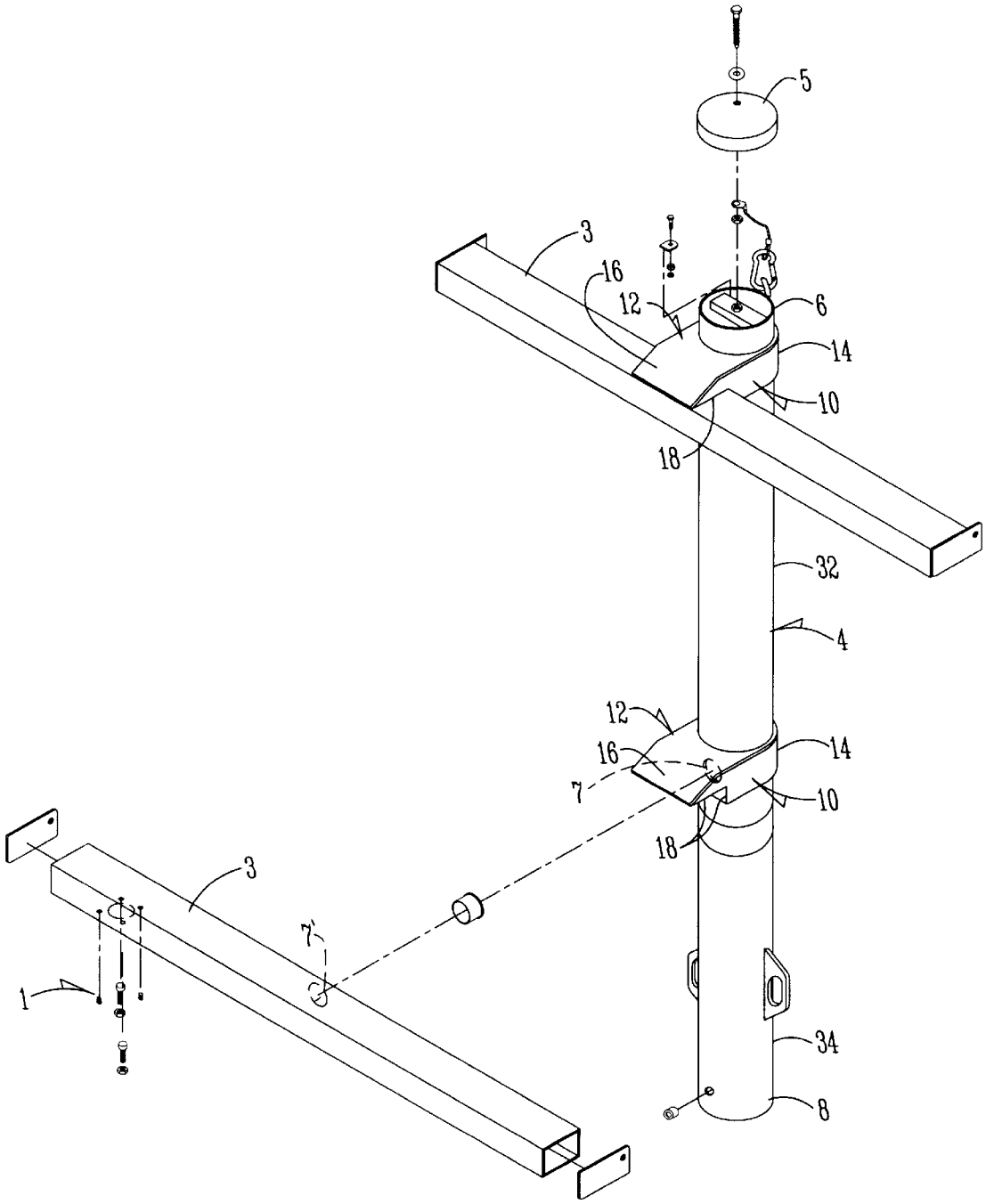
FIG. 2 is a partially exploded view of FIG. 1.

A preferred embodiment of the present invention, in comparison, is shown at FIGS. 1 and 2. Spacers 10, like spacers 2, connect cross-arms 3 to pole top section 4. Spacer 10 includes a main body 12 that includes a portion 14 which completely surrounds pole 4. A second portion 16 is essentially an extension from main body 12. As can be seen (see also FIG. 4), second portion 16 has a cut-out portion 18 which receives a cross-arm 3. As shown in FIGS. 1 and 2, therefore, extension portion 16, with its cut-out 18, abuts and allows securement between spacer 10 and a cross-arm 3 not only on one vertical flat side of cross-arm 3, but also extends over the top flat vertical part of cross-arm 3.

Figure 4:
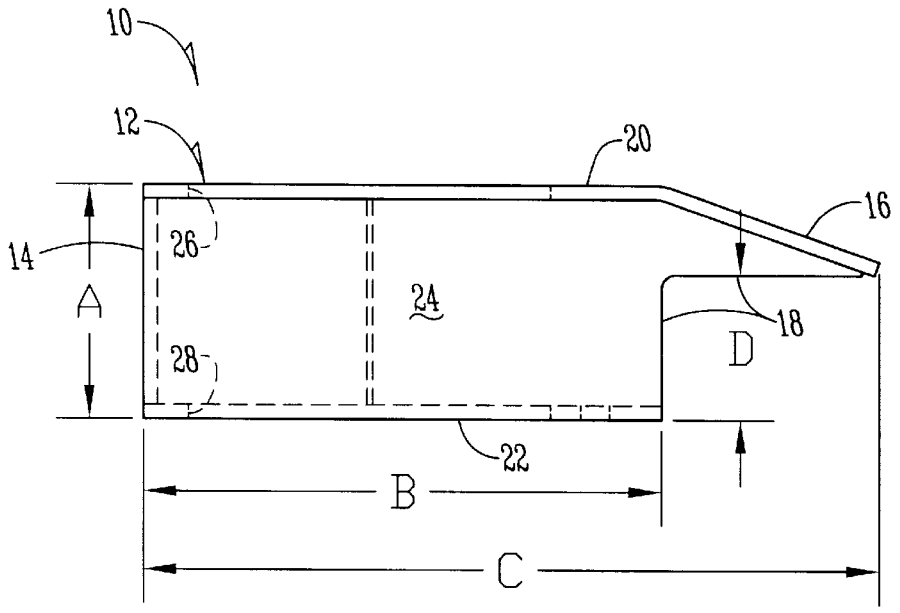
FIG. 4 is an enlarged side elevational view of a spacer according to Preferred embodiment of the present invention.
Figure 5:
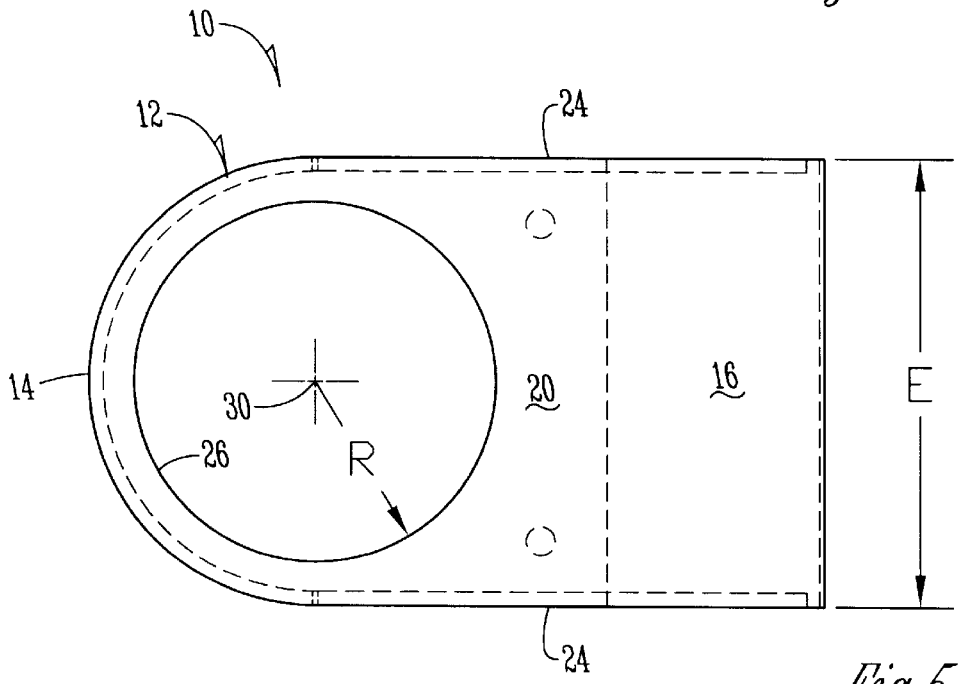
FIG. 5 is a top plan view of FIG. 4.

The specific construction of spacers 10 can be seen in more detail in FIGS. 4 and 5. Body 12 consists of an upper surface 20 and a bottom surface 22, and a side wall 24. As can be seen specifically in FIG. 5, an aperture 26 exists in top wall 20 and a similar aperture 28 exists in bottom wall 22. Apertures 26 and 28 are aligned along a central axis 30. The radius of apertures of 26 and 28 may or may not be the same depending on whether pole section 4 has a constant radius or is tapered from top to bottom. The interior of body 12 is generally hollow. Body 12 is open to its interior at the area defined by cut-out 18.

The following table provides dimensions (see FIGS. 5 and 6) with respect to a spacer 10 associated with a 6.06" diameter opening or aperture 26:

| LETTERS | DIAMETER |
|---|---|
| A | 3.13" |
| B | 7.38" |
| C | 10.69" |
| D | 1.94" |

-continued

| LETTERS | DIAMETER |
|---|---|
| E | 7.00" |
| R | 3.03" |

Spacer 10 can be made of the material as described with regard to spacer 2 or other similar materials such as are well-known in the art.

Figure 6:
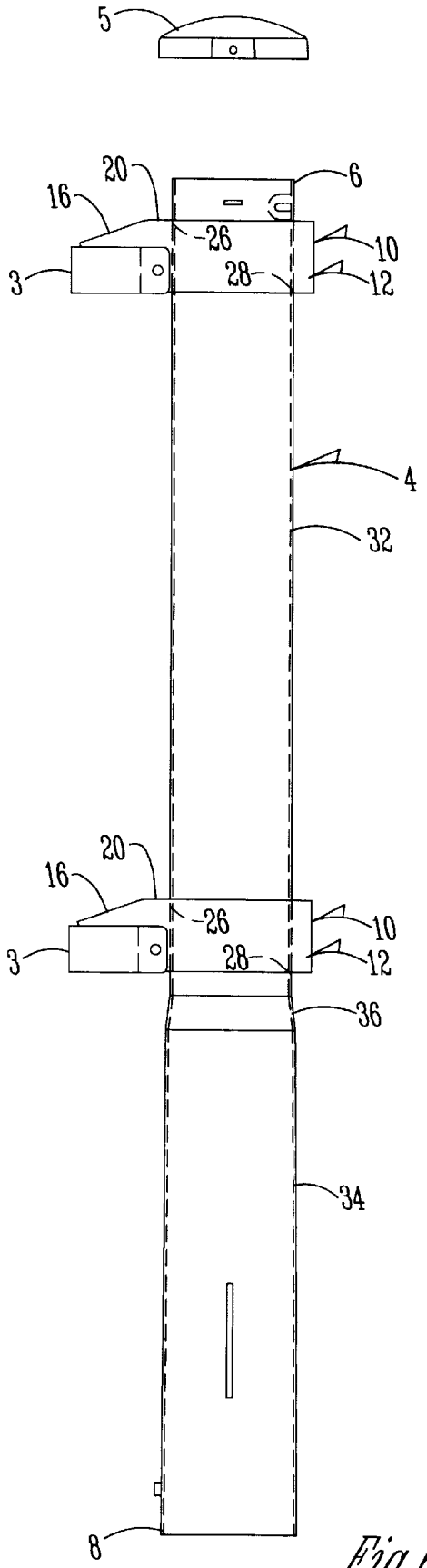
FIG. 6 is an enlarged side elevational view of FIG. 1 with a top cover for the pole top section shown in exploded fashion.
Figure 7:
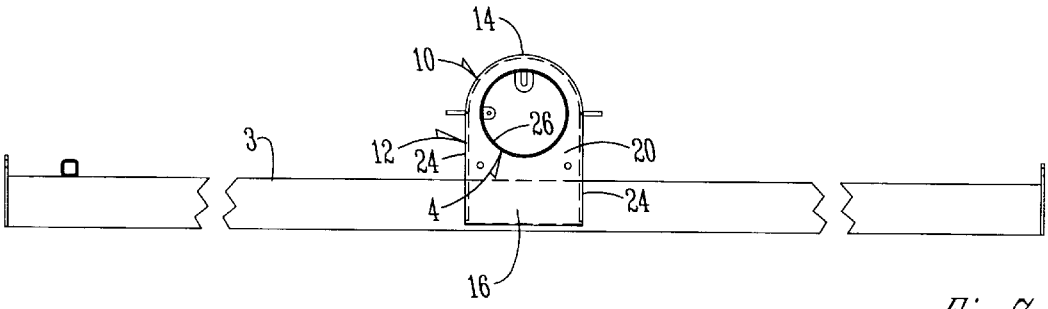
FIG. 7 is a top plan view of FIG. 6 with the top cover removed and not shown.
Figure 8:
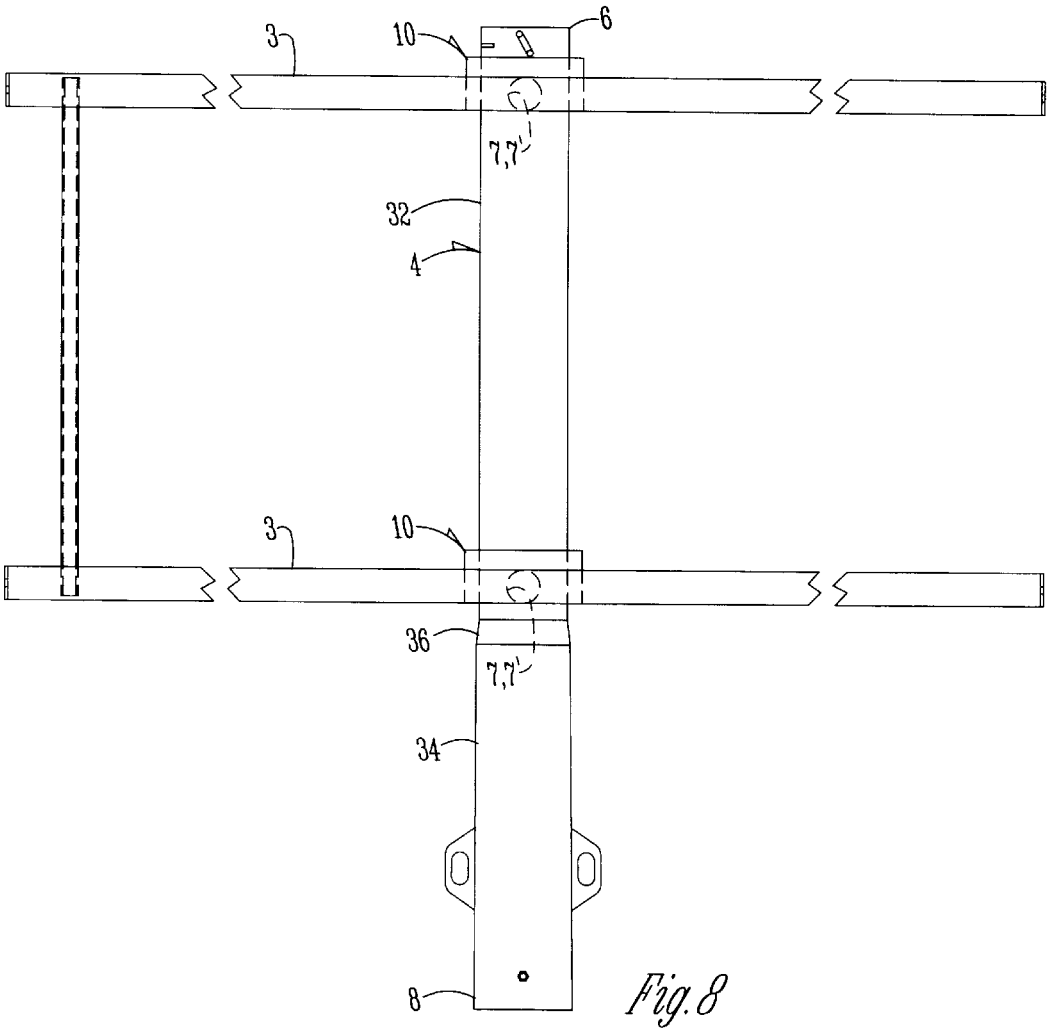
FIG. 8 is a front elevational view of FIG. 6.

FIGS. 6–8 illustrate the assembly of spacers 10 to a pole top 4 and then the attachment of cross-arms 3 to spacers 10. By referring to FIG. 6, the uppermost part of pole section 4 (indicated at reference numeral 32), can be formed of hollow metal tube of 6.06" approximate outside diameter. The diameter can be constant all the way down to step 36 between upper section 32 and lower section 34 of pole portion 4. The spacers 10 of FIGS. 4 and 5 could be slipped over the top end of upper part 32 of pole top 4 and slid down to their intended point of attachment. By referring back to FIG. 2, both spacers 10 would be positioned at a point along pole 4 where apertures 7 exist in pole 4. By means well within the skill of those skilled in the art, both spacers would be rotationally adjusted so that they are aligned with holes 7 and so that extensions 16 point in the correct orientation. Both spacers 10 would then be welded into place on upper part 32 of pole section 4.

FIG. 6 shows that the cover-plate 5 for pole section 4 is detachable for access to the hollow interior of pole section 4.

As FIG. 6 shows, spacers 10 completely surround pole 4 and thus have attachment support and structural support all the way around pole 4.

The next step would be to attach cross-arms 3 to spacers 10. As shown in FIGS. 6, 7, and 8, the cross-arms could then be brought into place in cut-outs 18. By methods well within the skill of those skilled in the art, each cross-arm 3 can be accurately positioned relative to spacers 10 and then welded into place. As shown in FIGS. 6–8, spacers 10 would not only abut the closest vertical side of cross-arm 3, but also the top of cross-arm 3 for additional support. Note how the top side of extension 16 is sloped down or tapered to its outer edge.

Therefore, by comparing FIGS. 2 and 3, the major differences between spacers 2 and 10 can be seen.

The included preferred embodiment is given by way of example only and not by way of limitation to the invention which is solely described by the claims herein. Variations obvious to one skilled in the art will be included within the invention defined by the claims.

What is claimed:

1. A spacer adapted for connection between a vertical pole over twenty feet tall and a horizontal cross-arm, the spacer comprising:

a first end portion including a passageway adapted for receipt and surrounding of a vertical pole;

a second end portion adapted for attachment to a cross-arm, the second end portion extending from the first portion outwardly relative to the passageway; and a middle portion between the end portions to space the second end portion from the first end portion, the middle portion being generally tubular having walls defining an interior space.

2. The spacer of claim 1 wherein the first end portion encircles said passageway and has top and bottom surfaces and a thickness.

3. The spacer of claim 2 wherein the second portion has a distal cross-arm receiver including an extended section tapered to an outer edge.

4. The spacer of claim 3 wherein the cross-arm receiver of the second portion comprises a cut-out section which is adapted to mate with outside dimensions of a cross-arm.

5. The spacer of claim 1 further comprising a pole, the spacer slip fits onto the pole and is welded in place along the pole.

6. The spacer of claim 5 further comprising cross-arm welded to the second portion of the spacer.

7. The spacer according to claim 5 further comprising a second spacer and cross-arm, each spacer and corresponding cross-arm positioned on a single pole.

8. The spacer of claim 1 combined with a pole top section, the pole top section being hollow and having a lower end which is adapted to be slip-fit onto the top end of a pole.

9. The spacer of claim 1 wherein an upper side of the second end portion is adapted to receive a cross-arm.

10. The spacer of claim 1 combined with a light pole.

11. The spacer of claim 10 further comprising a cross-arm attached to the second end portion.

12. The spacer of claim 11 further comprising at least one light fixture attached to the cross-arm.

13. A pole top assembly for attachment to the top of a pole, the pole top assembly comprising:

a pole section made of hollow metal;

at least one cross-arm for supporting items;

a spacer between the pole section and the cross-arm;

the spacer comprising a metal body having a top and bottom sides, and front and back ends, and side walls defining an interior space, the back end of the spacer having a curvature generally matching the perimeter of the pole section, the body having an aperture on the top and bottom aligned along an axis defining a passageway through the spacer adapted to matingly receive and surround the pole section, the front end having a lip extension from the top of the body to which the cross-arm can be attached at a spaced position from the pole section.

14. A method of attaching a cross-arm to a hollow metal pole comprising the steps of:

attaching a hollow metal member to the hollow metal pole so that the member surrounds the pole;

extending the hollow metal member outwardly of the pole, including providing a portion which extends over the top of the cross-arm;

attaching the cross-arm to a distal part of the hollow metal member, wherein the cross-arm is held at distance from the pole.

15. The method of claim 14 wherein the extended part of the member abuts against a proximal side of the cross-arm and extends over the top of the cross-arm.

16. The method of claim 14 wherein the member is attached to the pole and the cross-arm by welding at junctions there between.

17. The method of claim 14 wherein the pole is a light pole.

* * * * *

UNITED STATES PATENT AND TRADEMARK OFFICE

CERTIFICATE OF CORRECTION

PATENT NO. : 6,250,596 B1
DATED : June 26, 2001
INVENTOR(S) : Gordin et al.

It is certified that error appears in the above-identified patent and that said Letters Patent is hereby corrected as shown below:

Column 6,
Line 13, please insert -- a -- following comprising.
Line 35, please insert -- , -- following bottom; and delete "sides, and".

Signed and Sealed this

Thirtieth Day of April, 2002

*Attest:*

*Attesting Officer*

JAMES E. ROGAN
*Director of the United States Patent and Trademark Office*